United States Patent [19]

Powers et al.

[11] Patent Number: 4,884,594

[45] Date of Patent: Dec. 5, 1989

[54] COMPACT TWIN PISTON PUMP

[75] Inventors: Richard G. Powers, Prairie Village, Kans.; Joseph G. Currier, Lees Summit, Mo.; Joseph S. Zeets, Olathe, Kans.

[73] Assignee: Marlen Research Corporation, Overland Park, Kans.

[21] Appl. No.: 308,208

[22] Filed: Feb. 9, 1989

Related U.S. Application Data

[60] Division of Ser. No. 207,889, Jun. 16, 1988, which is a continuation-in-part of Ser. No. 106,563, Oct. 6, 1987, abandoned.

[51] Int. Cl.[4] ..... F04B 7/00; F16K 3/02

[52] U.S. Cl. ..... 137/625.48; 251/175; 417/900

[58] Field of Search ..... 137/625.48, 625.49, 137/625.4; 417/900; 251/175

[56] References Cited

U.S. PATENT DOCUMENTS

| | | | |
|---|---|---|---|
| Re. 32,041 | 11/1985 | Heckmann et al. | 137/625.48 X |
| 999,575 | 8/1911 | Livingston | 137/625.48 |
| 1,681,328 | 8/1928 | Erickson | 137/625.48 |
| 2,750,962 | 6/1956 | Kreitchman et al. | 137/625.48 |
| 2,820,479 | 1/1958 | Jenkins, Jr. | 137/625.48 |
| 2,828,937 | 4/1958 | Kreitchman | 251/175 X |
| 3,306,321 | 2/1967 | Bastle | 137/625.48 |
| 3,398,693 | 8/1968 | Schumann | 417/900 |
| 3,682,575 | 8/1972 | Guddal et al. | 137/625.48 X |
| 3,768,774 | 10/1973 | Baugh | 251/175 |
| 3,771,561 | 11/1973 | Santamaria, Jr. | 137/625.48 X |
| 3,811,802 | 5/1974 | Semple | 417/900 X |
| 3,868,048 | 2/1975 | Soodalter | 417/469 X |
| 3,871,616 | 3/1975 | Taylor | 251/175 |
| 4,097,962 | 7/1978 | Alley et al. | 417/360 X |
| 4,224,363 | 9/1980 | Veronesi et al. | 417/360 |
| 4,381,100 | 4/1983 | Schoenberg | 251/175 X |
| 4,382,450 | 5/1983 | Tennick | 251/175 X |
| 4,533,300 | 8/1985 | Westerlund et al. | 417/900 X |
| 4,776,564 | 10/1988 | Westenberg | 251/175 X |

FOREIGN PATENT DOCUMENTS

| | | | |
|---|---|---|---|
| 231959 | 1/1986 | Fed. Rep. of Germany . | |
| 59-579 | 1/1984 | Japan . | |
| 99006 | 9/1961 | Norway | 137/625.48 |
| 671029 | 4/1952 | United Kingdom . | |

*Primary Examiner*—John Rivell

*Attorney, Agent, or Firm*—Hovey, Williams, Timmons & Collins

[57] ABSTRACT

A compact, relatively low cost twin piston pump (20) especially adapted for the pumping of foods (e.g. juices, puddings or particulates such as stews and chilies) is provided which includes quick detach yoke and clevis assemblies (108, 124, 110, 126) connecting the reciprocable pistons (100, 102) with their associated hydraulic cylinders (116, 118), thereby permitting quick cleanup of the machine (20). A jacking screw plate (136) is used for forward mounting of the piston and cylinder assemblies (84, 86, 116, 118) coupled with the sleeves (42, 44) and associated pistons (100, 102). This permits precise adjustment of the working components of the machine, while eliminating expensive bearings and heavy duty framing members. The pump (20) is also provided with a slide plate-type valve (38, 184) for controlling output of product from the pump (20). In one valve embodiment (184) a two-part metallic slide plate assembly (192, 200) is sandwiched between a pair of apertured nylon plates (186). One of the slide plate parts (200) is of lesser thickness than the primary part (192), so as to permit limited fore-and-aft movement of the part (200) for sealing purposes. A unique hydraulic system employing a master pressure reducing valve (222) and a slaved pressure reducing valve (224) is employed for creating a pressure differential across the part (200) in order to bias the same for sealing purposes.

3 Claims, 7 Drawing Sheets

COMPACT TWIN PISTON PUMP

This is a division of application Ser. No. 07/207,889, filed on June 16, 1988, which is a continuation-in-part of identically titled application Ser. No. 07/106,563, filed Oct. 6, 1987 now abandoned.

BACKGROUND OF THE INVENTION

1. Field of the Invention

The present invention is broadly concerned with a relatively compact twin piston pump of the type used for pumping foods (e.g., juices of various types and particulates) during processing operations. More particularly, it is concerned with a compact pump having a number of unique features significantly reducing the cost of the pump as compared with conventional, relatively large twin piston pumps. To this end, the pump hereof includes structure for permitting quick disassembly of the pistons and sleeves to facilitate rapid cleanup, with complete elimination of expensive sleeve/piston mounting components used in conventional pumps; a specialized, jacking screw plate for permitting fine adjustment of the hydraulic cylinder assemblies used to drive the sleeves and pistons; and novel slide-plate valving arrangements adjacent the outlet of the pump which are used in lieu of expensive-to-fabricate rotary valves or the like.

2. Description of the Prior Art

Twin piston pumping devices have been in use for a number of years, particularly in the food industry in the processing of fluid and particulate materials. A particularly successful twin pump device has been commercialized by Marlen Research Corporation of Overland Park, Kans. This pumping device is described in U.S. Pats. No. 4,097,962, 3,456,285, and 3,108,318. Broadly speaking, the Marlen Pump includes a pair of elongated, tubular, alternately and axially shiftable sleeves which receive corresponding pistons. The sleeves and pistons are moved through appropriate hydraulic piston and cylinder assemblies in order to effectively deliver a continuous stream of product form the pump outlet.

The standard Marlen machine employs six-inch diameter sleeves and pistons, and can develop a product output of up to about 10,000 pounds per hour, depending on the product being pumped. Such a device, by virtue of the high capacity thereof, requires somewhat specialized and expensive components. As specifically described in U.S. Pat. No. 4,097,962 (which is incorporated by reference herein), the standard Marlen Pump employs an operating and control pack comprising hydraulic power devices for the sleeves and pistons mounted on a common plate. The plate is in turn supported by a pair of rearward spherical bearings permitting precise alignment of the pack components. These bearings also allow the pack and the associated sleeve and piston assemblies to be pivoted upwardly for disassembly. The latter involves, inter alia, unthreading each piston from its associated piston rod.

The existing high capacity Marlen Pump further includes a rotatable plug valve situated in a Y-outlet conduit in order to selectively open and close the legs of the conduit to maintain continuous product flow. Such a rotary valve is an expensive part, given the need to precisely machine curved surfaces so that the valve provides adequate sealing.

As indicated above, the existing Marlen machine has proved to be highly successful in operation. Generally speaking though, certain expensive componenets used in the machine are justified only when a given processor can utilize the high product flow rates inherent in the Marlen machine. In the case of relatively small scale operations however, the cost of the standard Marlen machine may be in excess of what a processor may be willing to pay. It would of course be possible to downsize the standard Marlen machine to provide a lower output unit. This approach does not really deal with the problem of using the rather expensive components of the standard Marlen, however.

There is therefore a decided need in the art for a smaller, more compact twin piston pump having all of the time-proven advantages of the standard large size Marlen twin piston pump, while at the same time avoiding as much as possible the use of expensive parts found necessary and desirable in the case of the large standard machine, but which may not be required in a smaller capacity pump.

SUMMARY OF THE INVENTION

The present invention overcomes the problems outlined above and provides a greatly improved, compact twin piston pump which can be produced at a sufficantly reduced cost. In one aspect of the invention, a piston pump is provided having sleeve and piston subassemblies which can be readily disassembled for cleanup purposes and which eliminate the need for spherical support bearings. In order to provide a desirable degree of adjustability between the hydaulic motive devices for the pump and the respective sleeves and pistons, a specialized jack screw plate is positioned between the hydraulic cylinders and sleeve and piston subassemblies; through the use of the jack screw plate the pump components can be precisely aligned while at the same time use can be made of light duty support framing.

Finally, the pump of the invention includes a unique slide plate-type valving assembly for controlling flow of product from the pump. In this way the expensive rotary outlet valve charactistic of prior twin piston pumps is completely eliminated. In one embodiment, a free-floating valve plate member is utilized together with an arrangement for creating a pressure differential against the plate member serving to bias the same into a product sealing disposition.

In practice, the preferred machine has sleeves and pistons of a nominal 4-inch diameter, and the machine will deliver a sustained output of three to six thousand pounds of product per hour, depending upon the type of product being pumped.

DESCRIPTION OF THE PREFERRED EMBODIMENTS

Figure 1:
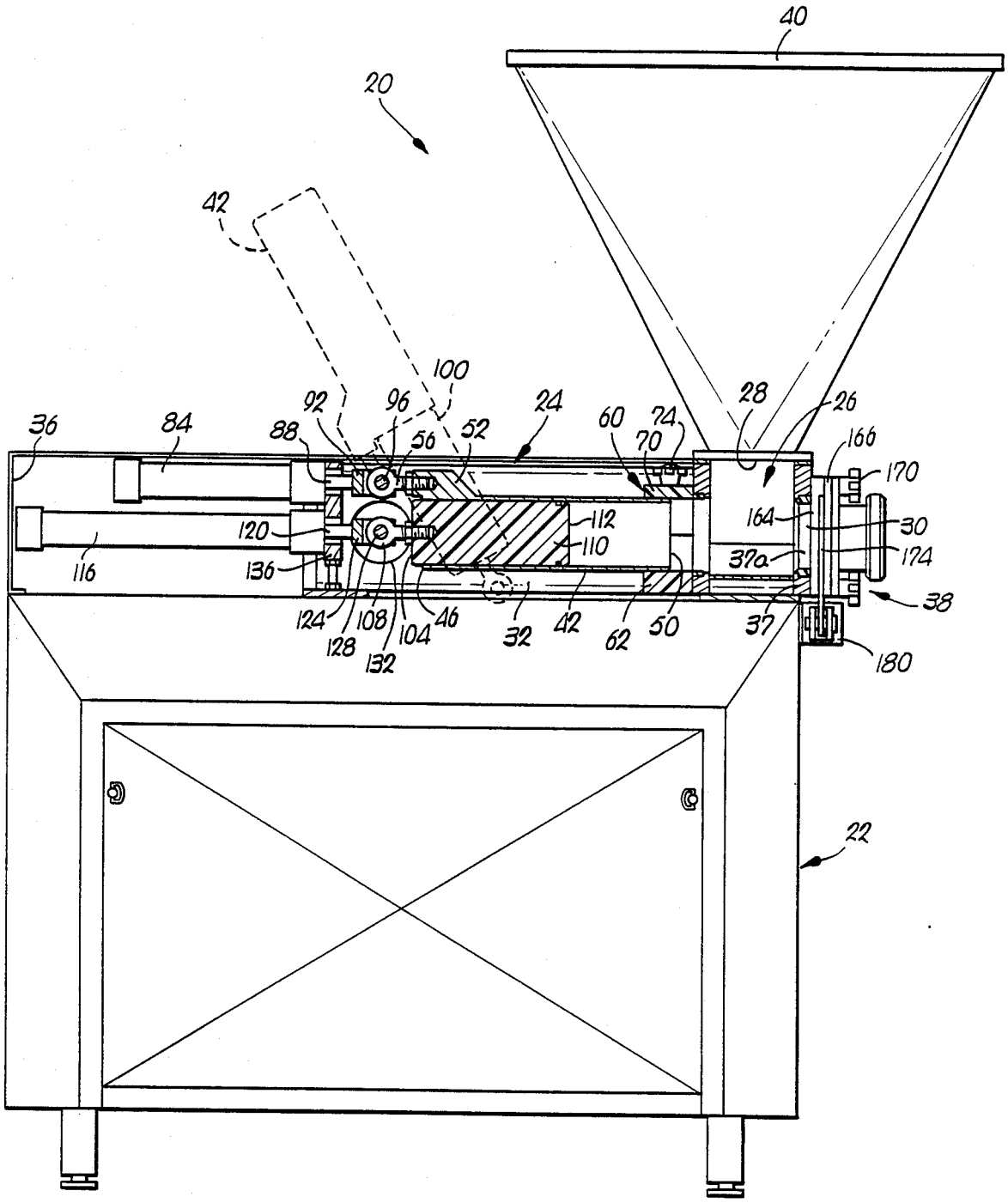
FIG. 1 is a side view in partial vertical section of a compact twin piston pump in accordance with the invention, with the disassembly position of the sleeves and pistons being ilustrated in dashed lines.

Turning now to the drawings, a compact twin piston pump 20 is illustrated in FIG. 1. Broadly speaking, the pump 20 includes a base cabinet 22 housing various motors and control circuitry for the pump, together with a pumping pack 24 situated atop cabinet 22. The pump includes a product receiving chamber 26 situated to the right of pack 24 as viewed in FIG. 1, with the chamber having a material inlet 28 and a material outlet 30. The pack 24 and chamber 26 are bordered by fore-and-aft extending sidewalls 32, 34, rear wall 36, front wall 37 having a pair of laterally spaced apertures 37*a* therethrough which cooperatively define outlet 30, and forward, apertured valve assembly broadly referred to by the numeral 38. A conical material hopper 40 is positioned above chamber 26, and is in communication with the latter through inlet 28.

In more detail, it will be seen that the pack 24 includes a pair of juxtaposed, elongated, tubular, axially shiftable metallic sleeves 42, 44, each having a rearward end 46, 48, and an opposed forward end 50. In addition, each sleeve includes a radially outwardly projecting connection block 52, 54 with associated clevis bolts 56, 58 threaded into a corresponding block 52, 54.

Figure 5:
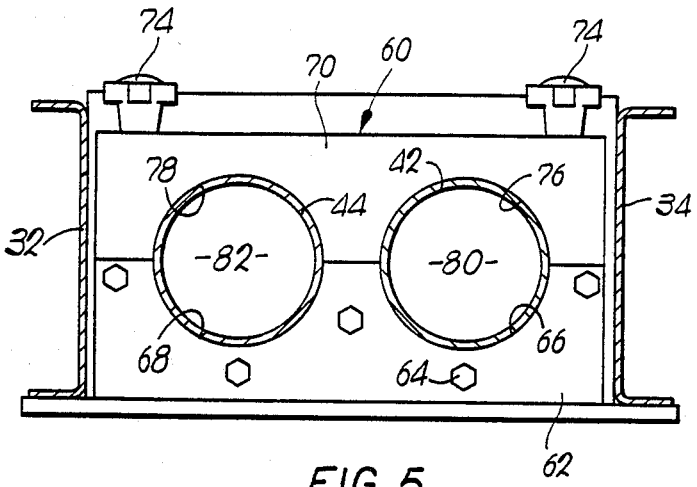
FIG. 5 is a rear elevational view of the sleeve guide forming a part of the pump of the invention.
Figure 6:
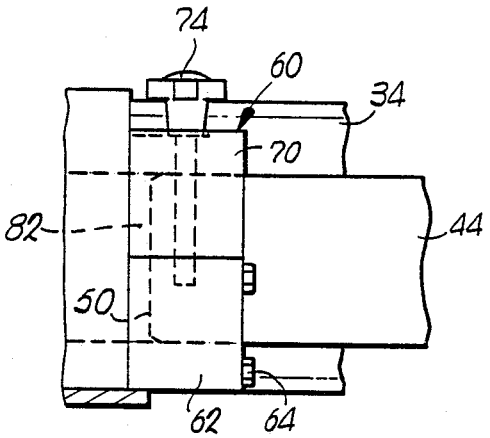
FIG. 6 is a fragmentary side view of the guide illustrated in FIG. 5, shown with a sleeve positioned within a guide aperture.

The forward ends 50 of the sleeves 42, 44 are slidably supported by means of a two-part guide 60 (see FIG. 5). The guide 60 includes a lowermost segment 62 secured to the machine frame by means of bolt 64 and presenting a pair of spaced-apart, rearwardly extending, upwardly opening, sleeve-receiving surfaces 66, 68. In addition, an upper guide segment 70 is provided which is releasably secured to the segment 62 by means of a pair of marginal attachment screws 72, 74. The upper segment 70 likewise includes a pair of spaced-apart, rearwardly extending, downwardly opening, sleeve-receiving surfaces 76, 78 which are aligned with the corresponding surfaces 66, 68. As will be readily appreciated from a study of FIGS. 5 and 6, the mated surfaces 66, 76 and 68, 78 cooperatively define a pair of laterally spaced-apart sleeve-receiving openings 80, 82.

Figure 2:
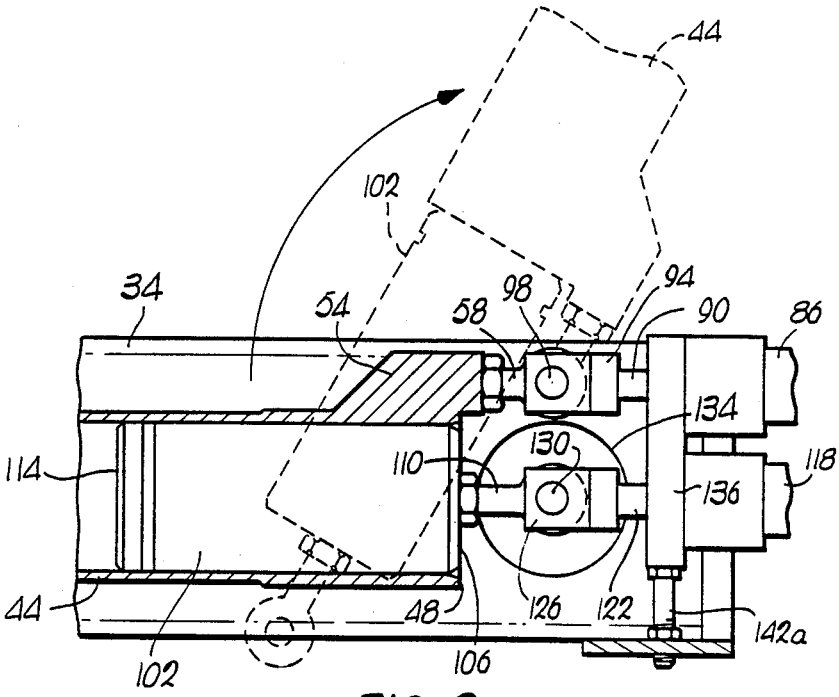
FIG. 2 is a fragmentary side view in partial vertical section illustrating in greater detail the mounting assembly for the respective sleeves and pistons, and again showing the disassembly position of the latter in dashed lines.

Each sleeve 42, 44 is shiftable fore-and-aft during operation of pump 20 by means of an associated piston and cylinder assembly 84, 86. These assemblies are conventional, and each includes the usual hydraulic cylinder together with an outwardly extending, shiftable piston rod 88, 90 terminating in a bifurcated yoke 92 or 94. As best seen in FIGS. 1 and 2, the yokes 92, 94 are interconnected with the associated clevis bolts 56, 58 by means of transverse pins 96, 98.

The pack 24 also includes a pair of elongated pumping pistons 100, 102 respectively received within corresponding sleeves 42, 44. Each piston includes a rearmost connection end 104, 106 which receives a rearwardly extending clevis bolt 108 or 110. Each piston further presents a beveled forwardmost pumping face 112, 114.

Motive power for the pistons 100, 102 is provided by associated piston and cylinder assemblies 116, 118 each having the usual cylinder as well as an elongated, forwardly extending shiftable piston rod 120 or 122 terminating in a yoke 124 or 126. Connection between the clevis bolts 108, 110 and the corresponding yokes 124, 126 is effected by means of quick-detach pins 128, 130. It should also be noted that each of the sidewalls 32, 34 is apertured at 132, 134 in order to provide easy access to the quick-detach pins 128, 130.

The four piston and cylinder assemblies forming a part of pack 24, namely assemblies 84, 86, and 116, 118, are mounted adjacent the forward ends thereof to a laterally extending adjustment plate 136. (See FIGS. 1–4). The plate 136 has appropriate apertures permitting passage of the piston rods 88, 90 and 120, 122 therethrough. The plate 136 is situated adjacent a pair of inwardly extending rigid frame panels 138, 140 and a total of six jacking screws 142 (three screws 142 being affixed in vertically spaced relation adjacent each side margin of the plate 136) are employed to couple plate 136 to the panels 138, 140. In addition, the underside of plate 136 is supported by a plurality of upstanding adjustable screws 142*a* (see FIGS. 2 and 3).

Figure 7:
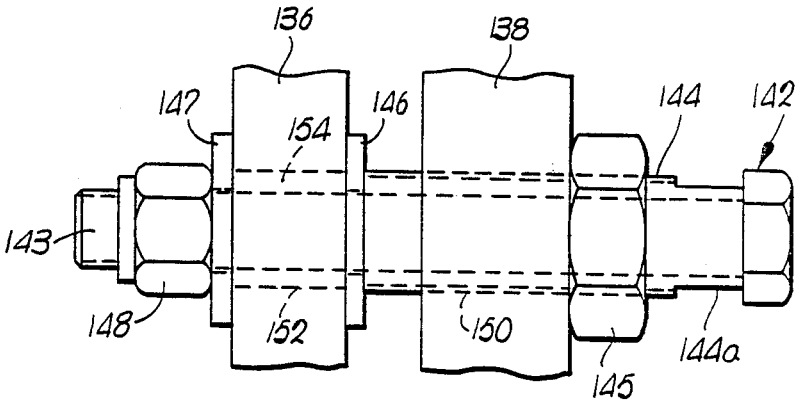
FIG. 7 is a greatly enlarged view of one of the jacking screws forming a part of the adjustable cylinder mounting plate.

Referring to FIG. 7, it will be seen that each jacking screw 142 includes an elongated threaded bolt 143, an externally threaded tube 144 telescoped over bolt 143, jam nut 145, washers 146 and 147, and locking nut 148. In addition, the associated frame panel 138 or 140 is provided with a threaded bore 150 adapted to receive the threaded tube 144, whereas the mounting plate 136 is provided with a bore 152 which is substantially enlarged relative to the diameter of bolt 143 so as to provide an adjustment clearance 154.

As assembled, the jacking screw 142 has tube 144 telescoped over the shank of bolt 143 and threadably received within bore 150. The tube extends from the enlarged head of bolt 143 into engagement with the righthand face of washer 146 as viewed in FIG. 7. The bolt 143 on the other hand extends through the associated frame panel 138 or 140 and likewise through the enlarged bore 152 of plate 136, with locking nut 148 securing the entire assembly together. In use, rotation of the threaded tube 144 through the medium of wrench flats 144*a* permits selective adjustment of the position of plate 136.

Figure 3:
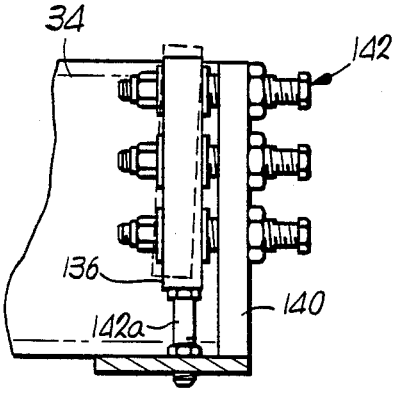
FIG. 3 is a fragmentary side view of the adjustable cylinder mounting plate forming a part of the invention, with an adjusted position of the plate being depicted in dashed lines.
Figure 4:
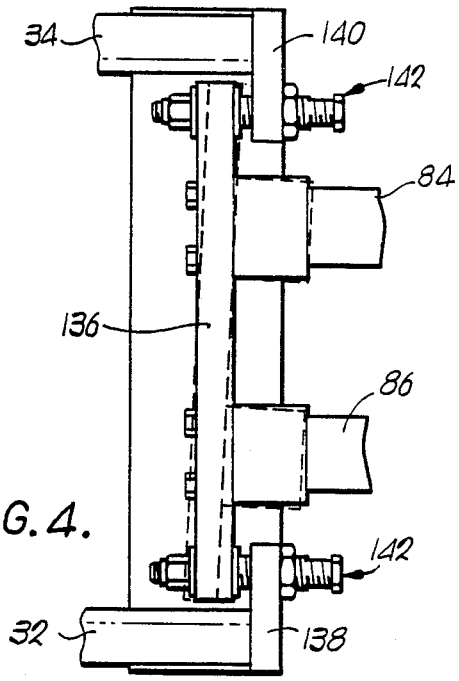
FIG. 4 is a plan view of the adjustable cylinder mounting plate depicted in FIG. 3, with a second adjusted position of the plate being shown in dashed lines.

As can be readily appreciated from a study of FIGS. 3 and 4, provision of the jacking screws 142 and adjustment screws 144 allows plate 136, and hence the supported piston and cylinder assemblies, to be precisely positioned within pack 24. Such adjustment can be in the vertical direction by use of the screws 142*a*, or about respective upright and horizontal axes (see FIGS. 4 and 3). By the same token, use of expensive expedients such as spherical bearings is completely eliminated.

Turning now to FIGS. 8 and 13–18, a valve assembly 38 used in the context of pump 20 is illustrated. Basically, the valve 38 includes a rearmost, synthetic resin (i.e., nylon) plate 164 which includes a pair of circular apertures 168, 168*a* therethrough which are in registry with the apertures 37*a* provided through front wall 37 (see FIG. 1 and 14). In addition, the valve 38 includes a forward nylon plate 166 which similarly is provided with a pair of openings 169, 169*a* therethrough which are oriented in registry with the apertures 168, 168*a* provided in rear plate 164 and apertures 37*a*. The two plates 164, 166 are secured together and are attached to front wall 37, by provision of a plurality of hand screws 170. In addition, plate 164 is provided with upper and lower integral, recess-defining marginal strips 171, 171*a* so as to present an elongated, partially open-bottom, slide plate-receiving channel 172. A metallic valving plate 174 is sandwiched between the plates 164, 166, and is laterally shiftable along the length of the channel 172. The plate 174 is also provided with an oval-shaped opening 176 therethrough which is strategically located for controlling flow of product from pump 20 as will be described. Finally, the plate 174 includes an integral, downwardly extending tang 175 which projects below the plates 164, 166. A piston and cylinder assembly 180 having an extensible rod 182 is provided directly beneath the valve plates and is coupled to tang 175 as illustrated. Accordingly, the back-and-forth lateral shifting of metallic valving plate 174 is controlled through the medium of assembly 180.

Attention is again directed to FIGS. 14 and 17–18, which depict the sealing structure associated with the valve 38. In particular, the plate 164 is provided with an oblong continuous, circumscribing recess in the face therof adjacent plate 174, which receives a similarly configured resilient sealing ring 164*a*. The opposite face of the plate 164 is provided with a pair of sealing rings 164*b* respectively encircling the openings 168, 168*a*, and in contact with the adjacent face of plate 37. In addition, the outer plate 166 includes an oblong recess in the face thereof adjacent slide plate 174, which likewise receives an oblong sealing ring 166*a*. Finally, the outer face of plate 166 is provided with a pair of circular seals 166*b* respectively disposed about each corresponding opening 169, 169*a*.

It will be seen that the slide plate 174 is of a substantially larger size than would be necessary for simple opening and closing of the valve apertures. Indeed, the plate 174 is of a size to maintain full contact with the entirety of the oblong seals 168*a*, 166*a*, throughout all of the operational positions of the plate 174. In this fashion, the oblong seals 164*a*, 166*a*, are retained in their respective grooves at all times, and are not dislodged during movement of the valve plate 174. It will also be appreciated that the described sealing arrangement prevents entrance or exit of air and/or flowable material from the valve passageways to the atmosphere.

Figure 13:
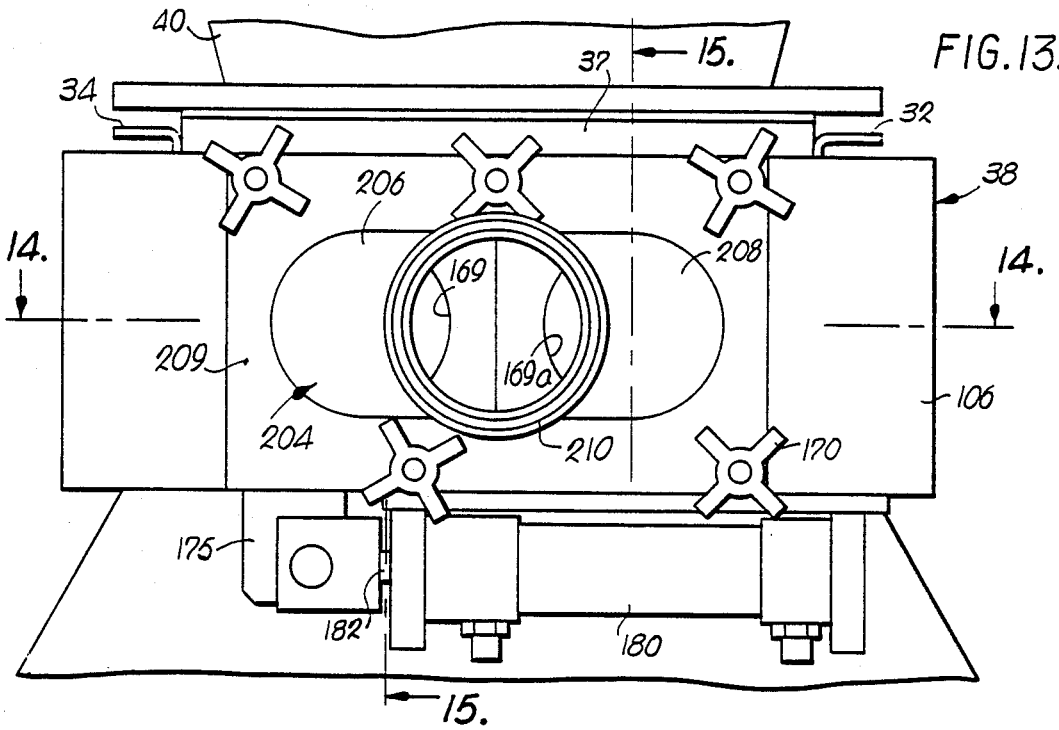
FIG. 13 is an elevational view similar to that of FIG. 8 but illustrates the valve and Y-shaped delivery conduit in operative combination.
Figure 14:
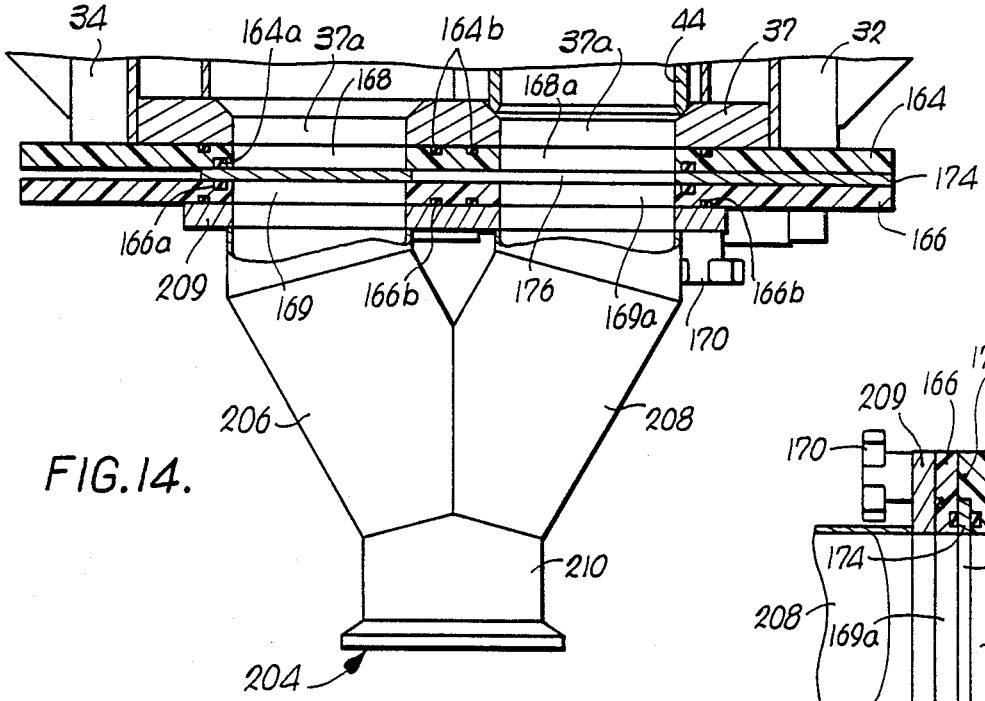
FIG. 14 is a fragmentary sectional view taken along line 14—14 of FIG. 13.
Figure 15:
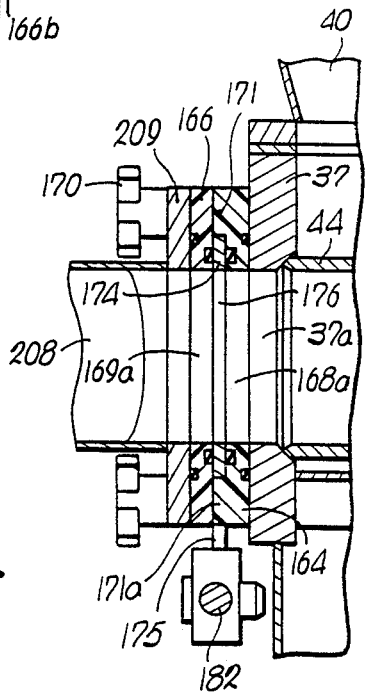
FIG. 15 is a vertical sectional view taken along line 15—15 of FIG. 13.
Figure 16:
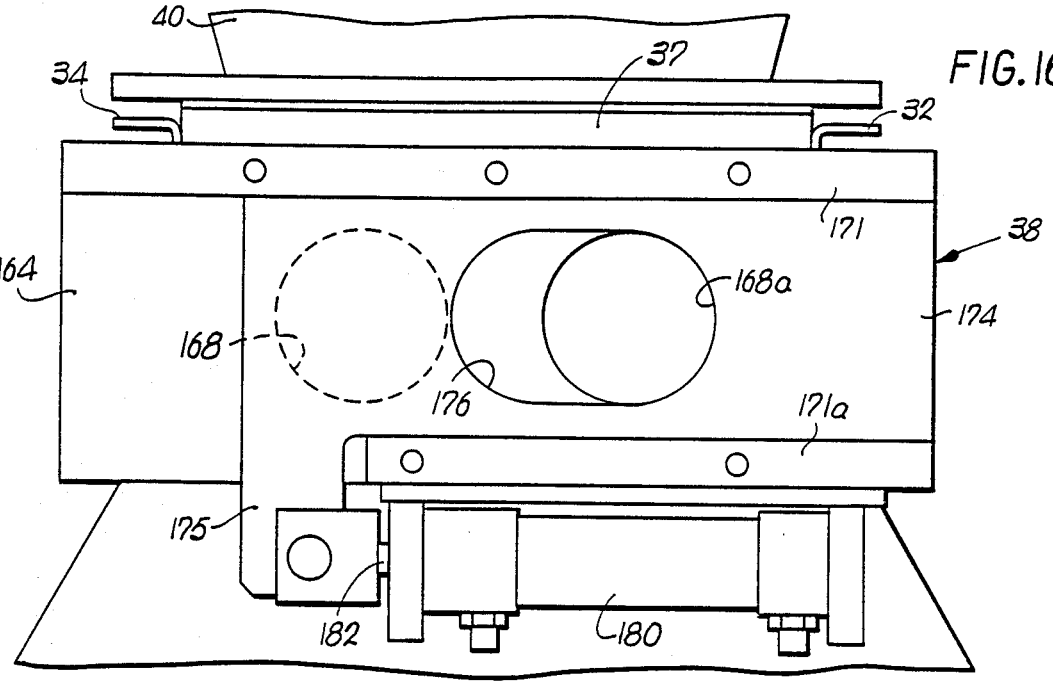
FIG. 16 is an elevational view of the valve of FIG. 13, shown with the Y-conduit forwardmost stationary valve plate removed.
Figure 17:
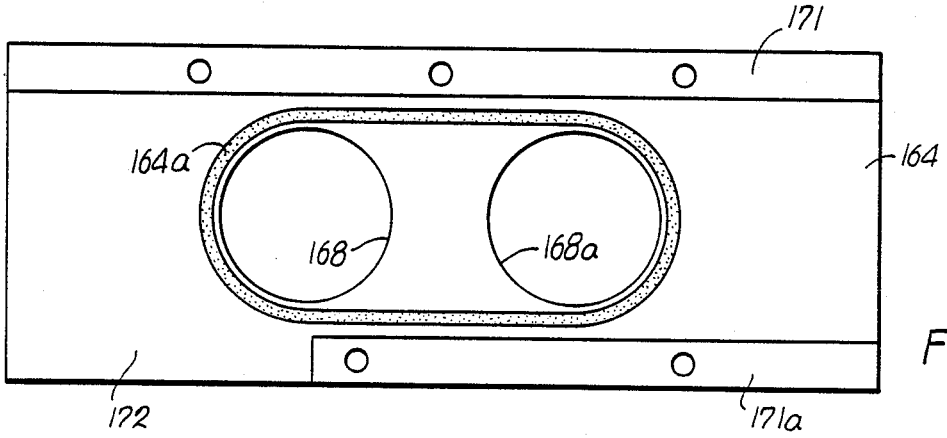
FIG. 17 is an elevational view of the rearmost stationary valve plate forming a part of the valve of FIG. 13, and illustrating the circumferential oblong seal carried by the plate.
Figure 18:
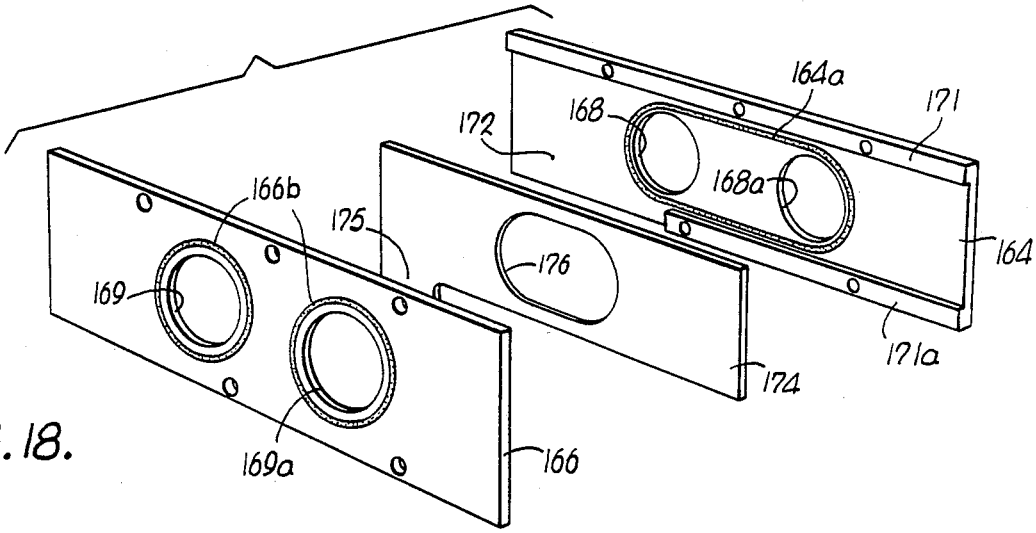
FIG. 18 is an exploded view of the plates making up the valve of FIG. 13.

In the embodiment of FIGS. 13 and 14, the outermost or outlet end of valve 38 remote from the pump proper is equipped with a Y-shaped in plan outlet conduit 204 having laterally spaced tubular legs 206, 208 merging in and leading to a contral discharge outlet 210. A flange plate 209 integral with conduit 204 is engaged by the screws 170, to hold the conduit in place with the legs 206, 208 in registry with the corresponding valve openings 169, 169*a*. Other outlet structure can, of course, be provided, such as that illustrated in FIG. 1.

In the use of valving assembly 38, the plate 174 can be shifted between extreme positions. In one extreme position illustrated in FIGS. 13 and 14, the opening 176 is in registry with righthand opening 169*a* in forward plate 166. In this orientation, free flow of product is provided from sleeve 44 through the associated opening 37*a*, the adjacent opening 168*a* in rearward plate 164, oval-shaped opening 176 and finally outwardly through the righthand opening 169*a*. At the same time though, the oval-shaped opening 176 does not extend to a point wherein it comes into registry with left-hand openings 168, 169. Therefore, the metallic plate 174 serves to completely block the lefthand side of the machine as viewed in FIGS. 13 and 14.

Figure 8:
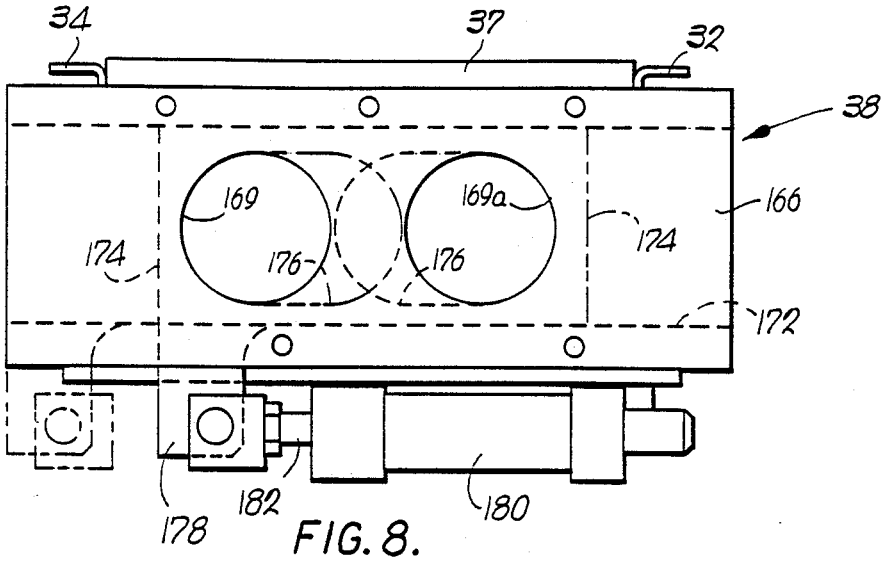
FIG. 8 is a front elevational view of a slide plate-type valve assembly in accordance with the invention, with respective extreme positions of the valve being shown in dashed lines and in phantom.

The opposite extreme position of plate 174 is illustrated in phantom in FIG. 8. In this orientation, the lefthand side of the machine is completely open, i.e., product flows freely through the openings 168, 169 whereas the openings 168*a*, 169*a* and thus the entire right side of the machine, is closed.

In the intermediate positions of valving plate 174 between the extreme positions depicted in FIG. 8, it will be appreciated that the product may flow from both sides of the machine simultaneously. In this fashion, continuous flow conditions are maintained from the pump 20.

As indicated previously, the size of valve plate 174, in cooperation with the stationary oblong seals 164*a*, 166*a* ensures that, during all operational aspects of the plate 174, an adequate seal is maintained. The seals 164*b*, 166*b* further enhance the integrity of the valve 38, and prevent any leakage of material during operation of valve 38.

Figure 9:
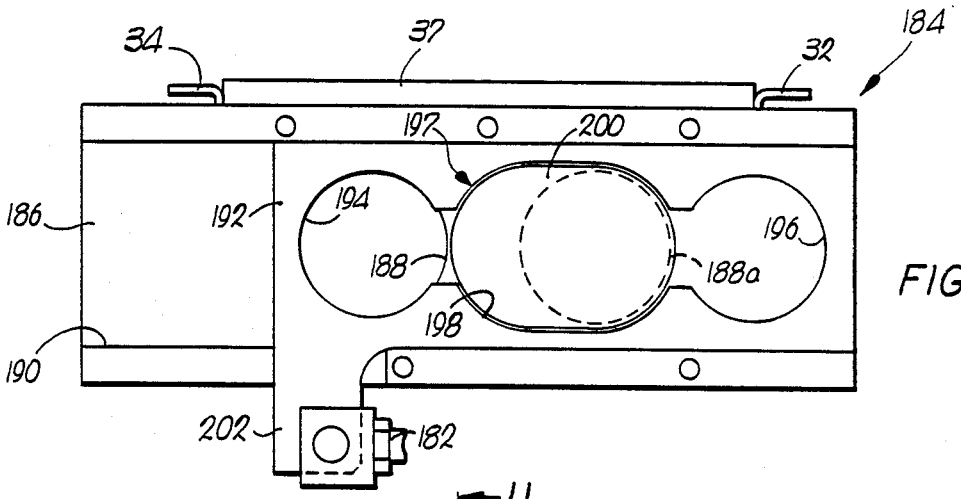
FIG. 9 is a fragmentary front view illustrating the rearmost plate and central valving plate assembly of another type of valve, shown with the central valving plate assembly in one extreme position thereof.
Figure 10:
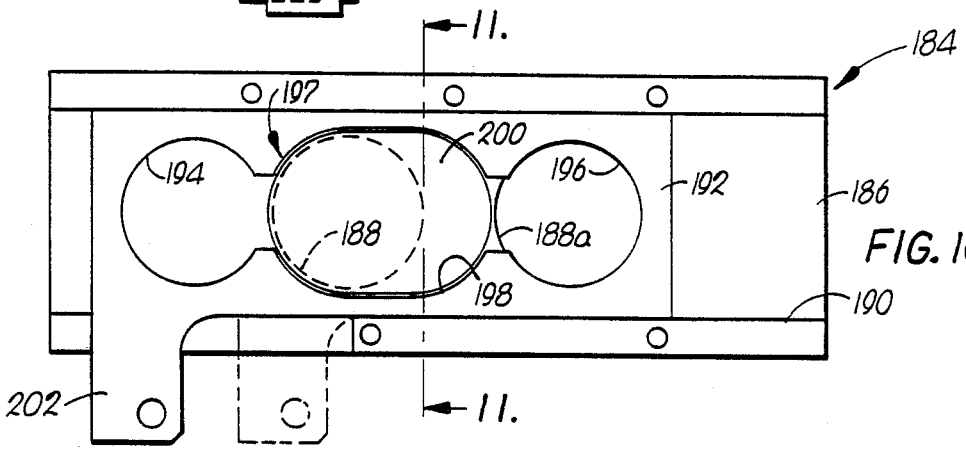
FIG. 10 is a view similar to that of FIG. 9, but showing the central valving plate assembly in the opposite extreme position thereof.
Figure 11:
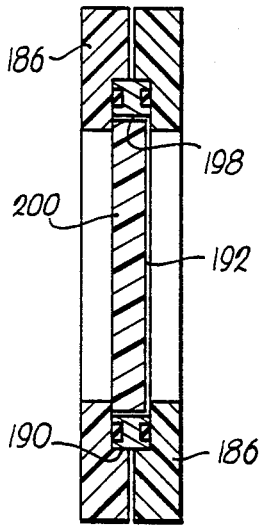
FIG. 11 is a sectional view taken along line 11—11 of FIG. 10 and further illustrating the construction of the valve.

Attention is next directed to FIGS. 9–11 which illustrate a second valving assembly 184. In this case the valving assembly includes a rearward synthetic resin plate 186 having apertures 188, 188*a* therethrough which are in registry with the previously described apertures 37*a*. In addition, an identical forwardmost plate (not shown) is also provided which is identical with the plate 186, i.e., it is provided with outermost apertures in registry with the apertures 188, 188*a*. Here again, the rearward and forward plates forming a part of the assembly 184 are cooperatively configured to present a slide channel 190 therethrough having an open bottom as in the case of channel 172.

The valving plate assembly of valve 184 is a specialized construction and includes a first primary metallic plate 192. The plate 192 includes a pair of circular apertures 194, 196 therethrough which are the size to substantially register with the apertures 188, 188a in rearward plate 186. However, it will be observed that the apertures 194, 196 are spaced-apart laterally a greater distance than the spacing between the apertures 188, 188a. The plate 186 is further provided with an elongated connecting opening 197 which extends between and communciates with the openings 194, 196. The connecting opening 197 includes a central, oval-shaped portion 198 having an effective diameter slightly greater than the openings 188, 188a.

Finally, a free-floating secondary synthetic resin plate 200 is situated within the oval-shaped portion 198. It will be seen in this respect that the plate 200 is itself oval-shaped and substantially conforms with the configuration of portion 198. As best seen in FIG. 11, the primary plate 192 has a thickness somewhat greater than the thickness of secondary plate 200. As a consequence, the plate 200 may float fore-and-aft within the confines of oval-shaped opening 198. The significance of this fact will be explained hereinafter.

The central valving plate assembly 184 is also provided with a pair of continuous, circumscribing oblong seals, situated within complemental recesses in each face of the plate 192 in surrounding relationship to the apertures 194, 196 and opening 197. These seals cooperate with the adjacent stationary valve plates to maintain the sealed integrity of the overall valve.

The extreme positions of valving assembly 184 are illustrated in FIGS. 9 and 10. Referring first to FIG. 9, it will be seen that plate 192 is shifted rightwardly to the extent that opening 196 is completely out of registry with righthand opening 188a. However, the free-floating plate 200 is in covering relationship to this aperture. On the other hand, the lefthand aperture 194 is in registry with the opening 188, so as to permit free, unrestricted flow of product from the lefthand side of pump 20. FIG. 10 illustrates the opposite extreme position, wherein aperture 194 is out of registry with the lefthand opening 188, whereas opening 196 is now in full registry with righthand opening 188a. The secondary plate 200 serves to block flow of material through lefthand opening 188. As a consequence, the machine is pumping unrestrictedly through the righthand side thereof.

It will of course be seen that the primary plate 192 includes a depending tang 202, the latter being coupled to a piston rod 182 in the manner identical to that described with reference to valving assembly 38. Accordingly, the associated piston and cylinder assembly serves to laterally shift the plate 192 leftwardly and rightwardly as desired. During such movement of the plate 192, the free-floating secondary plate 200 is of course captively retained and is moved with the plate 192; nevertheless, the plate may move a slight degree frontwardly or rearwardly as will be explained below. Finally, it will be readily appreciated that in the intermediate position of the valving assembly 184 between the extreme positions of FIGS. 9 and 10, that the secondary plate 200 may pass into bridging relationship to the apertures 188, so as to partially restrict flow through each of these apertures. This again achieves the desirable continuity of product flow from pump 20.

Figure 12:
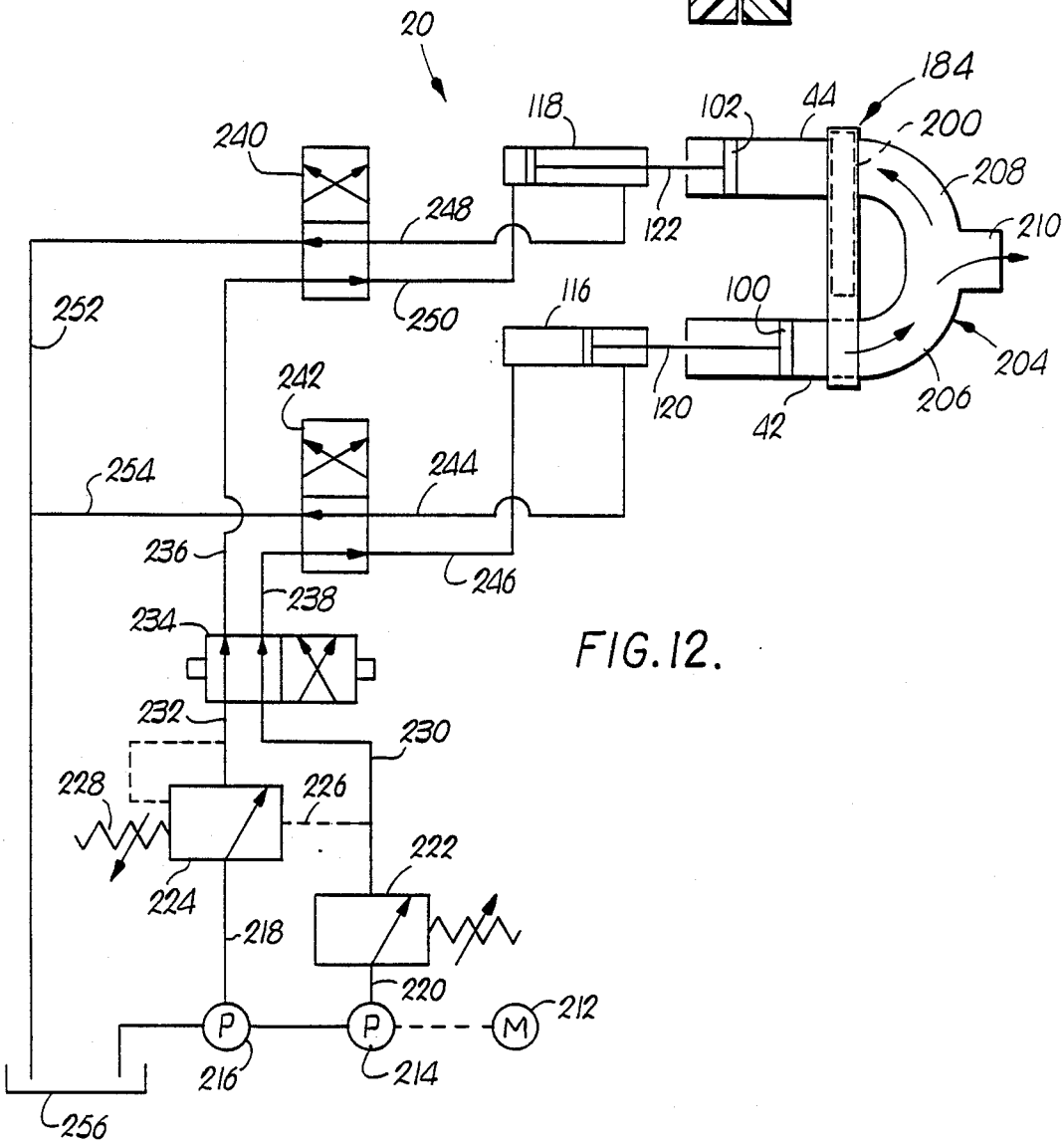
FIG. 12 is a schematic representation of certain components of the hydraulic system of the pump hereof, which illustrates a method of creating a sealing pressure differential on the free-floating plate of the valve depicted in FIGS. 9–11.

FIG. 12 illustrates an entirely schematic representation of operationally significant components of the pump 20, together with certain hydraulic circuitry particularly useful in conjunction with the valving assembly 184 of FIGS. 9–11. In this connection, it will be observed that the pump 20 is equipped with the previously described Y-shaped outlet conduit 204 having legs 206, 208 leading to discharge outlet 210.

Going on in FIG. 12, it will be seen that the device 20 includes a motor 212 serving to drive a pair of variable volume pumps 214, 216 which respectively provide a pressurized supply of hydraulic oil through lines 218, 220. A master pressure reducing valve 222 is interposed in line 220 and is typically manually adjusted to a desired maximum pressure limit. A slaved pressure reducing valve 224 is interposed in line 218 as indicated. A line 226 is connected from the output of valve 222 to the pilot port of slaved valve 224. The latter also includes an internal biasing device 228 which is important for purposes to be described.

The regulated pressure lines 230, 232 respectively connected to the outputs of the pressure reducing valves 222, 224 are connected to a circuit control valve 234. A pair of lines 236, 238 are connected from the output of valve 234 to, respectively, directional valves 240, 242. A pair of lines 244, 246 extend from the output of valve 242 to the two sides of the cylinder of piston and cylinder assembly 116. Similarly, a pair of lines 248, 250 are coupled from the output of valve 240 to the sides of the piston making up a part of piston and cylinder assembly 118. Finally, a pair of return lines 252, 254 extend from the valves 240, 242 to the oil reservoir 256.

In the operation of a dual piston pumping device such as pump 20, it is necessary to divide the hydraulic pressurized oil supply into two separately controllable streams of oil, one stream to operate a pumping stroke on one piston, while the other serves to retract and reload the adjacent piston and sleeve for reloading purposes. Once the sleeve undergoing reloading has been retracted and again extended to confine a charge of product within the sleeve, it is necessary to pressurize the contents of the sleeve to same (or near the same) pressure of the product that is actually being pumped from the adjacent sleeve. This procedure of pressurizing the product prior to pumping is termed "precompress". Proper precompress of the product allows a smooth transistion of the exchange from the pumping piston that is near the end of its stroke to the piston that is fully charged. If the precompress is done at too low pressure, then a pause in the product line will occur when the "charged" piston moves enough to compress the product up to its operating pressure. If the precompress is done at a pressure higher than the pumping pressure, then a surge in the product line will occur as the over-compressed product expands into the product line.

When using a pump to move a product, there are many factors that influence the pressure required to move the product at the desired rate such as product viscosity, length of conduit, size of particles or pieces in the product, and inherent frictional factors. As these conditions change, the hydraulic pumping pressure will change as a function of the product resistance. As the product resistance goes up, the hydraulic pressure will go up, and conversely as the product resistance goes down, the hydraulic pressure will go down. To ensure smooth operation, it is very desirable that the precompress pressure change along with the pumping pressure.

Referring again to FIG. 12, it will be appreciated that the pump 216 makes use of a slaved pressure reducing valve to control the precompress pressure. As shown in that figure, the piston 100 is in its pumping stroke for expelling product from sleeve 42, while the adjacent piston 102 is in its precompress stage. As a consequence, the secondary valving plate 200 of valving assembly 184 is in its extreme position depicted in FIG. 9, i.e., the righthand aperture 188 of FIG. 9 is completely covered.

In any event, during this operational sequence, pressurized hydraulic oil in line 230 passes through circuit control valve 234 and is thereupon directed to the respective control valves 240, 242. These valves in turn direct pressurized oil via line 246 to the rearmost point of the hydraulic cylinder, while oil from the forward port is exhausted through line 244, valve 242, and ultimately to reservoir 256 through line 254. Simultaneously, pressurized oil in line 232 is directed through valve 234 to directional control valve 240, whereupon it is likewise directed to the rear port of the associated hydraulic cylinder. Exhaust fluid passes via line 248 through valve 204 and line 252 to the reservoir 256. Inasmuch as the valve 224 is slaved to the valve 222, it will be seen that the pressure in line 232 will follow that of line 230. However, it is sometimes desirable to set the biasing device 228 of valve 224 so that the pressure in line 232 is slightly less (e.g., 5 p.s.i.) than the pressure in line 230. Under these circumstances, it will be seen that the precompress pressure exerted by the piston 102 is slightly less than the pressure of the products being pumped by the piston 100. By virtue of the intercommunication between the legs 206, 208, it will be apparent that product pumped from sleeve 42 passes through the Y conduit and engages the face of secondary plate 200 remote from piston 102. Thus, a pressure differential is created across the plate 200 which serves to bias the same into tight, sealing engagement with the righthand aperture 188 as viewed in FIG. 9. This assures a pressure seal within the valve, which can be particularly important in the case of insignificantly compressable products such as water, milk, or fruit juices.

As the piston 100 nears the end of its stroke, the valve-controlling piston and cylinder assembly 180 is activated to begin shifting the primary and secondary plates 192, 200 leftwardly as viewed in FIGS. 9 and 10. At this time the circuit control valve 234 will shift, connecting lines 230 and 236, and conversely lines 232 and 238. This in turn creates a pressure within assembly 118 equal to the manually set pressure of valve 222, so that the piston 102 begins its pumping stroke. At substantially this time, the direction control valve 242 is shifted so as to intercommunicate lines 238 and 244, and lines 246 and 254. This serves to retract piston 100 in sleeve 42, whereupon the latter is retracted by its associated piston and cylinder assembly 84. Upon full retraction and return extension of the sleeve 42 to entrap a charge of product, the directional valve 242 then returns to its position illustrated in FIG. 12, whereupon the piston 100 is precompressed at the slightly reduced pressure regulated by slaved valve 224.

In short, the precompress pressure is a function of the slaved oil pressure transmitted via valve 224. Of course, if the product resisting changes or there are other upsets within the system and the pumping pressure drops, the slaved precompressed pressure will drop proportionately, maintaining the desired pressure differential by means of the internal biasing device 228. This permits the secondary plate 200 to maintain its sealing function under all normal conditions of operation.

When use is made of the valving assembly 38 depicted in FIG. 8 (such being more commonly employed when particulate products are being pumped), then the slaved valve 224 can be set equal with that of the master valve 222, and the pumping and precompress pressures will be equal. In all other respects though, the operation of the system will be as described above.

When pump 20 is shut down for cleaning purposes, the respective sleeve and piston assemblies can be readily dismantled. In particular, the operator first detaches upper segment 70 of guide 60 (FIG. 5) by loosening the screws 72, 74. Next the quick detach pins 128, 130 are manipulated through the sidewall apertures 132, 134, in order to remove the pins from the yoke and clevis assemblies interconnection the piston rods 120, 122 with the associated clevis bolts 108, 110. At this point the individual sleeves and pistons may be rotated upardly about an axis transverse to the longitudinal axes of the sleeves as illustrated in phantom in FIGS. 1 and 2, whereupon the pistons may be removed from the rearward ends of the sleeves for cleanup purposes. If desired, the sleeves can be detached as well by disassembling the corresponding yoke and clevis assemblies. Of course, reassembly of the machine components involves simply a reversal of the above described steps.

We claim:

1. Valve means adapted for coupling to a source of pressurized, flowable material which delivers said material from a pair of spaced outlet openings, said valve means comprising:

a rear plate adjacent said outlet openings and having a pair of apertures therethrough in registry with said outlet openings;

a front plate in face-to-face relationship with said rear plate and having a pair of holes therethrough in alignment with said apertures;

means operatively connecting said front and rear plates together, there being a channel defined between said front and rear plates;

a valving plate assembly situated within said channel and slidable between a first extreme position completely blocking one of said apertures while permitting free flow through the other of said apertures, and a second extreme position completely blocking said other aperture and permitting free flow through said one aperture, said valving plate assembly including structure for, at an intermediate position thereof between said extreme positions, permitting simultaneous partial flow of material from both of said apertures, said valving plate assembly comprising a first plate having a thickness and a continuous opening therethrough, said first plate opening including respective endmost portions configured for registry with associated rear plate apertures, said endmost portions being farther apart than said rear plate apertures and being interconnected by an elongated connection portion, there being a second, free floating plate member within said elongated connection portion, said second plate member having a thickness less than said first plate and being sized for covering said one aperture when said valving plate assembly is in said first extreme position thereof, and for covering the other of said apertures when said valving plate assembly is in said second extreme position thereof, there being means for biasing said free floating second plate member towards an associated rear plate aperture when the valving plate assembly is in said extreme positions thereof.

2. Valve means adapted for coupling to a source of pressurized, flowable material which delivers said material from a pair of spaced outlet openings, said valve means comprising:

a rear plate adjacent said outlet openings and having a pair of apertures therethrough in registry with said outlet openings;

a front plate in face-to-face relationship with said rear plate and having a pair of holes therethrough in alignment with said apertures;

means operatively connecting said front and rear plates together, there being a channel defined between said front and rear plates;

a valving plate assembly situated within said channel, presenting an opening therethrough having an open area greater than either of said apertures or holes, and slidable between a first extreme position completely blocking one of said apertures with said opening out of communication with said one aperture while permitting free flow through the other of said apertures and through said opening, and a second extreme position completely blocking said other aperture with said opening out of communication with said other aperture, while permitting free flow through said one aperture and said opening, said opening being oriented on said valving plate for, at an intermediate position thereof between said extreme positions, permitting simultaneous partial flow of material from both of said apertures, through said opening, there being a pair of inner seals respectively disposed adjacent opposite faces of said valving plate assembly and each of said seals being of a size to circumscribe said pair of apertures and said pair of holes and said opening, said valving plate assembly being of a size to maintain constant contact with the entirety of each of said inner seals in all operational positions of said valving plate assembly, whereby to maintain the sealed integrity of the valve means; and two pairs of outer seals, one pair thereof being disposed adjacent the face of said front plate remote from said valving plate and respectively in circumscribing relationship with said front plate holes, the other pair of outer seals being disposed adjacent the face of said rear plate remote from said valving plate and respectively in circumscribing relationship with said rear plate apertures.

3. The valve means of claim 2; said seals being respectively seated in corresponding recesses provided in the faces of said rear and front plates adjacent said valving plate assembly, said valving plate assembly being shiftable relative to said seals.

* * * * *